US008155356B2

(12) United States Patent
Liou et al.

(10) Patent No.: US 8,155,356 B2
(45) Date of Patent: Apr. 10, 2012

(54) STRUCTURE AND MANUFACTURING METHOD OF ELECTROSTATIC SPEAKER

(75) Inventors: Chang-Ho Liou, Changhua County (TW); Ming-Daw Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 886 days.

(21) Appl. No.: 12/175,467

(22) Filed: Jul. 18, 2008

(65) Prior Publication Data

US 2009/0067648 A1 Mar. 12, 2009

(30) Foreign Application Priority Data

Sep. 6, 2007 (TW) ..... 96133208 A

(51) Int. Cl.
*H04R 19/00* (2006.01)

(52) U.S. Cl. ..... 381/191

(58) Field of Classification Search ..... 381/191
See application file for complete search history.

(56) References Cited

U.S. PATENT DOCUMENTS 3,894,199 A 7/1975 Tamura et al.
2007/0195976 A1 8/2007 Sekino et al.

FOREIGN PATENT DOCUMENTS

TW 200726300 7/2007

OTHER PUBLICATIONS

"Office Action of Taiwan Counterpart Application" issued on Aug. 20, 2010, p. 1-p. 6.

*Primary Examiner* — Alexander Ghyka
*Assistant Examiner* — Stanetta Isaac
(74) *Attorney, Agent, or Firm* — Jianq Chyun IP Office

(57) ABSTRACT

A structure of an electrostatic speaker and a manufacturing method thereof are provided. In the electrostatic speaker, an electrode and a vibrating film are disposed closely, and electrostatic force of the vibrating film may make the vibrating film contacting with the electrode such that the speaker would fail to generate the sound. Thus, the invention provides a spacer structure and a manufacturing method thereof. Various patterning or height changes and other designed are performed to place the spacer between the electrode and the vibrating film, so as to prevent the electrode from contacting with the vibrating film. The disposition of the spacer is expected to enhance frequency response or sound volume of the speaker.

35 Claims, 6 Drawing Sheets

STRUCTURE AND MANUFACTURING METHOD OF ELECTROSTATIC SPEAKER

CROSS-REFERENCE TO RELATED APPLICATION

This application claims the priority benefit of Taiwan application serial no. 96133208, filed on Sep. 6, 2007. The entirety of the above-mentioned patent application is hereby incorporated by reference herein and made a part of specification.

BACKGROUND OF THE INVENTION

1. Field of the Invention

The present invention relates to a structure and a manufacturing method of an electrostatic speaker. More particularly, the present invention relates to a structure and a manufacturing method of a spacer in a flat plane electrostatic speaker.

2. Description of Related Art

The most direct two senses of human being are visual and auditory systems, so for quite a long time, scientists are devoting to develop related element or system techniques. Recently, electroacoustic speakers are mainly classified into a direct radiating type and an indirect radiating type, and are approximately classified into dynamic speakers, piezoelectric speakers, and electrostatic speakers according to driving manners. Recently, the dynamic speaker is most widely used, and has a mature technology, so it is the main technology dominating the whole market. However, due to the disadvantages of the original architecture, the volume cannot be flattened, and therefore, the dynamic speaker cannot meet the requirement of the trend that the 3C (computer, communication, and consumer electronics) products become increasingly smaller and the family theater becomes flatter. As for a piezoelectric speaker, piezoelectricity of a piezoelectric material is utilized, such that when an electric field is applied on the piezoelectric material, the material deforms, so as to push a vibrating film to sound. Although the structure of the speaker is flattened and microminiaturized, it cannot be flexible as the piezoelectric material requires to be sintered.

Recently, the market of the electrostatic speaker is mainly hi-end earphones and loudspeakers. The operating principle of the conventional electrostatic speaker is sandwiching a conductive vibrating film with two fixed electrode plates with openings to form a capacitance, supplying direct voltage bias to the vibrating film and giving audio alternating voltage to the two fixed electrodes, thereby driving the conductive vibrating film to vibrate by a electrostatic force generated by positive and negative electric fields, so as to radiate the audio out. The bias of the conventional electrostatic speaker must be up to hundreds to thousands of volts, so it is necessary to externally connect amplifiers with high unit price and large volume, and it is the reason why it cannot be popularized. The structural design of using the electrostatic speaker together with the ferroelectric vibrating film may reduce the audio driving voltage, however, the electrostatic effect of the vibrating film makes the electrode contact with the vibrating film and the speaker fail to sound.

In technical application related to flexible electronics, sound is an important factor. However, the flexible electronics must have characteristics of soft, thin, having low driving voltage, and flexible, so it is a key point how to adopt the flat plane electrostatic speaker, together with the selection of the flexible material, to break through the conventional fixed speaker design structure, and to finish sound components with the features required by the flexible electronics.

For the electrostatic speaker, an electroacoustic transducer is provided in US patent publication NO. 3,894,199. As shown in FIG. 1, a holding member 11 made of an insulating material holds two fixed electrodes 120. A vibrating film 130 is located between the two electrodes. The fixed electrode 120 has many holes 121 for the radiation of the sound to pass through. A polarization voltage 141 flows through the vibrating film 130, each fixed electrode 120, and passes through a step-up transformer 140 and a resistor 142. A primary winding of the step-up transformer 140 is connected to a signal source 15. Potentials of the two fixed electrodes 120 are provided by an alternating signal of the signal source 15. The potentials of the two fixed electrodes are opposite, that is, one is positive and the other is negative.

In view of the above, the holding member 11 is only used to hold the fixed electrodes 120, and no spacer exists between the vibrating film 130 and the fixed electrodes 120. It can be known that recently related design description on the spacer of the flat plane speaker has not been proposed yet.

SUMMARY OF THE INVENTION

The present invention is directed to provide a spacer structure design of a flat plane speaker, so as to solve the technical problem that the electrode and the vibrating film contact with each other due to the electrostatic force and fail to sound. The spacer of the speaker has a simple assembly construction and can match with the current technology to perform the process, and thus it is suitable for mass production, so as to make the flat plane electrostatic speaker product be practical.

In an embodiment, the speaker structure provided by the present invention includes a vibrating film, an electrode, a frame spacer, and a plurality of spacers. The electrode has a plurality of openings, and the frame spacer constructs the outline of the speaker structure and is used to fix the vibrating film and the electrode on two corresponding sides. The spacers are disposed between a non-opening region of the electrode and the vibrating film, thereby preventing the vibrating film form contacting with the electrode. The vibrating film at least includes an electret layer and an electrode layer.

The layout of disposition of the spacers is determined according to magnitude of the electrostatic effect of the vibrating film. In an embodiment, the height of the spacer and/or the distance of the adjacent spacers can be adjusted.

In another embodiment, the speaker structure provided by the present invention includes a vibrating film, an electrode, a frame spacer, and a plurality of spacers. The frame spacer constructs the outline of the speaker structure, and is used to fix the vibrating film and the electrode on the two corresponding sides. The spacers are disposed between the non-opening regions of the electrode and the vibrating film according to a preset layout, thereby preventing the vibrating film form contacting with the electrode.

The layout of disposition of the spacers is determined according to the magnitude of the electrostatic effect of the vibrating film. In an embodiment, the height of the spacer and/or the distance of the adjacent spacers can be adjusted.

In an embodiment, the electrode is composed by a plurality of strip electrodes disposed in a crossed manner, and the spacers are selectively disposed on the non-opening regions at the crossed positions. The spacers can be of a point structure, a grid structure, or a quasi-cross structure etc.

In an embodiment, a method of manufacturing the speaker provided by the present invention includes forming an electrode; forming a frame spacer for constructing the outline of the speaker structure and fixing the electrode at one side; and forming a vibrating film fixed on the other side of the frame spacer. The electrode and the vibrating film are fixed on the frame spacer in a face-to-face manner, and a plurality of spacers is disposed between the non-opening regions of the electrode and the vibrating film, so as to prevent the vibrating film from contacting with the electrode.

In an embodiment, the spacers are formed on the electrode or the vibrating film by means of transfer-printing including jet printing or screen printing. In another embodiment, the spacers are formed on the electrode or the vibrating film by means of adhering, in which the spacers are adhered or not adhered to the vibrating film or the electrode.

In an embodiment, the spacers are formed on the electrode or the vibrating film by means of etching or photolithography.

In order to make the aforementioned and other objects, features and advantages of the present invention comprehensible, preferred embodiments accompanied with figures are described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
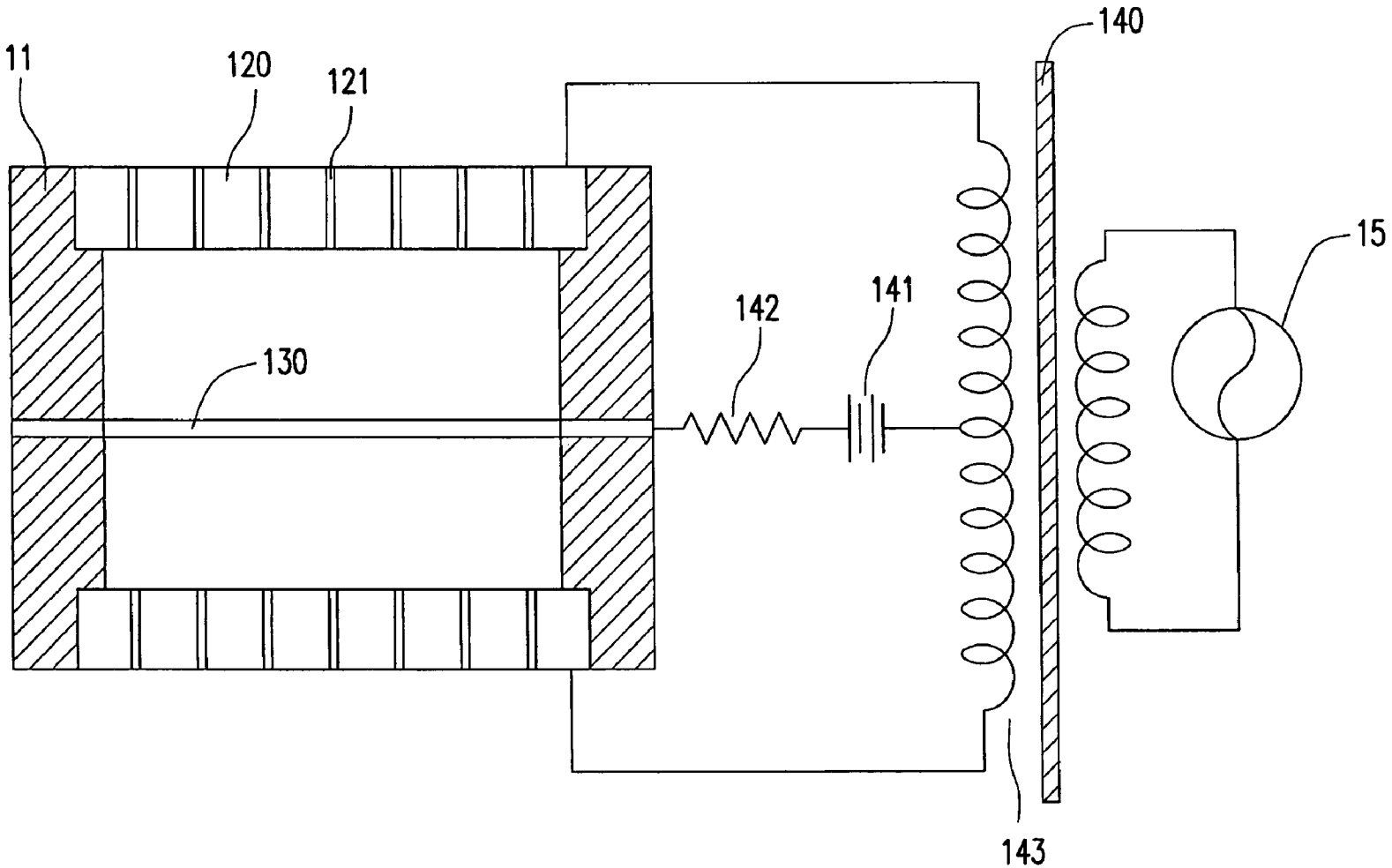
FIG. 1 (PRIOR ART)
FIG. 1 is a schematic view of the disposing manner of a conventional electrostatic speaker.

The present invention provides a spacer structure design of a flat plane speaker, so as to solve the technical problem that electrode and the vibrating film contact with each other due to electrostatic force and fail to sound. The spacer of the speaker has simple construction and can match with the current technology to perform the process, so it is suitable for mass production, such that the flat plane electrostatic speaker product becomes practical. The electrode can be metal material or other conductive materials, and openings can be disposed on the electrode to increase the diffusing effect of the sound through the holes. The vibrating film at least includes an electret layer made of electret material and a conductive electrode.

For the conductive electrode, if the metal electrode is adopted, in order not to affect tension and vibrating effect of the electret layer, it can be an extremely thin metal film electrode with a thickness of 0.3 μm. Considering that the extremely thin metal film electrode is exposed in the air when using, and it will be oxidized to form a full insulator, thereby affecting the input of the sound source signal, an insulation layer is fabricated on the surface of the metal thin film electrode, but it is necessary to pre-leave a position for the input end of the sound source signal. In addition, the conductive electrode can also adopt oxidized and conductive material, and can also adopt light transmissive conductive material, such as one of indium tin oxide (ITO), indium zinc oxide (IZO), and aluminum zinc oxide (AZO).

The spacer structure design of the speaker of the present invention is one of the important structure constructing technologies of the flat plane speaker. For the spacer structure design, the spacers are placed between the electrode and the vibrating film, so as to solve the conventional technical problem that the electrode and the vibrating film contact with each other due to the electrostatic force of the vibrating film in the flat plane electrostatic speaker structure and fail to sound. The spacers structure located between the electrode and the vibrating film can have different layouts according to different requirements. The geometric outline arrangement is determined according to the magnitude of the electrostatic effect of the vibrating film, for example quasi-rectangle, round, or triangle, and other arrangement manners. The arrangements of the geometric outline can use the distance between the spacers or the disposition of the height of the spacer etc. In addition, the whole layout design of the spacers can also be considered, including adopting the layout manners such as point layout, grid layout, or quasi-cross layout. For the outline of the spacer, different geometric shapes can be adopted, including triangular prism, circular cylinder, or rectangle etc.

For the structure design and the manufacturing method for the spacer of the speaker provided by the present invention, it can be directly fabricated on the electrode, or can be directly fabricated on the vibrating film. The spacers can adopt two designing manners that the spacers are adhered or not adhered to the vibrating film or the electrode. Alternatively, the spacers can be fabricated in advance, and then, the spacers are placed between the electrode and the vibrating film after finishing the fabrication.

The manufacturing method of the spacer structure provided by the present invention includes using the transfer-printing or decaling to form the spacers on the electrode or the vibrating film. The manufacturing process of the spacer can also adopt a printmaking technology, including direct printing or lamination manner. The direct printing includes screen printing manner. The manufacturing process of the spacer can also be formed by means of photoresist growing or etching.

The flat plane electrostatic speaker applies the charge characteristics in the vibrating film material and the principle of electrostatic force effect. After the vibrating film is excited by an external voltage, the surface of the vibrating film is deformed, so as to drive the air around the vibrating film to generate the sound. It can be known form electrostatic force formula and energy law that the force applied on the vibrating film is equal to the capacitance value of the whole speaker multiplied by magnitude of the internal electric field and the externally input sound voltage signal. The larger the force applied on the vibrating film is, the larger the output sound is. According to Coulomb's law, product of the charges of two electrified objects is proportional to the mutually interacted electrostatic force, and is inversely proportional to the square of the distance between the two. If both of the two charges are positive or negative, mutually exclusive electrostatic forces are applied on the objectives. When one of the charges is positive and the other is negative, mutually attracting electrostatic forces are applied on the objectives. The electrostatic force formula can be shown by equation 1.

$$P = \frac{2V_{in}V_e\varepsilon_0\left(\frac{1}{S_a} + \frac{\varepsilon_e}{S_e}\right)\varepsilon_e S_e}{(S_e + \varepsilon_e S_a)^2} \quad \text{(equation 1)}$$

Vacuum capacitivity is $\in_o = 8.85\times10^{-12}$ F/m, the dielectric constant of the electret is $\in_e$, the thickness of the electret is $S_e$, and the thickness of air layer is $S_a$, the voltage of input signal is $V_{in}$, the voltage of the electret is $V_e$, and the unit force applied on the vibrating film is P. Therefore, if under the same distance, the electrostatic speaker can provide a high ferroelectricity, the audio alternating voltage input to the speaker can be reduced to several volts to tens of volts, so as to improve the practicability of the flat plane electrostatic speaker.

Therefore, the present invention provides the following implementation, that is, the electrode having the opening can use metal or conductive material, and the opening on the metal material used here is help for the diffusion of the sound. In another embodiment, a conductive electrode layer can be plated on an extremely thin piece of paper, so as to achieve the same effect.

In an embodiment, the vibrating film contains electret materials, for example dielectric materials. The dielectric material can keep the static charges for a long time after being electrized, and ferroelectric effect can be generated in the material after charging, so it can be referred to as an electret vibrating film. The electret vibrating film can be the vibrating film fabricated by one or more layers of dielectric materials, and the dielectric materials can be, for example, fluorinated ethylenepropylene (FEP), polytetrafluoethylene (PTFE), polyvinylidene fluride (PVDF), a portion of Fluorine Polymer, and other suitable materials. The electret vibrating film is the vibrating film capable of keeping the static charges and piezoelectricity for a long time after the dielectric material is electrized. It is possible form the electret vibrating film to contain Nano/Micro holes to increase light transmittance and piezoelectricity, the dipolar charges are generated in the material after corona charging, so as to generate the ferroelectric effect.

The material of the spacer adopts transparent and flexible materials, such as plastic material, so as to increase the diversity of the spacer application design.

In the following, detailed embodiments are used for illustration according to the spacer structure design of the speaker.

Figure 2A:
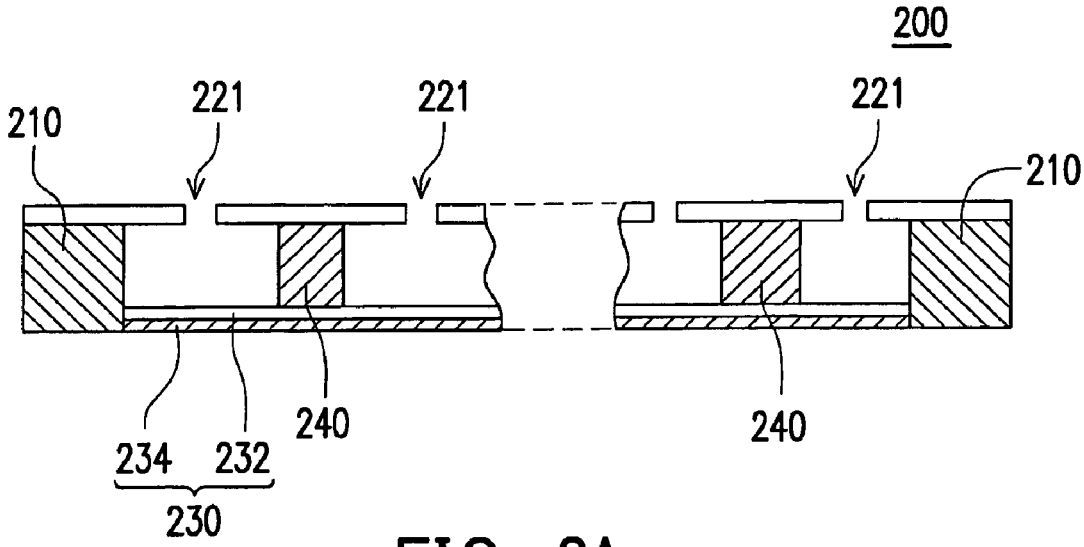
FIGS. 2A and 2B are schematic sectional views of structure and function of a spacer according to a first embodiment of the present invention.
Figure 2B:
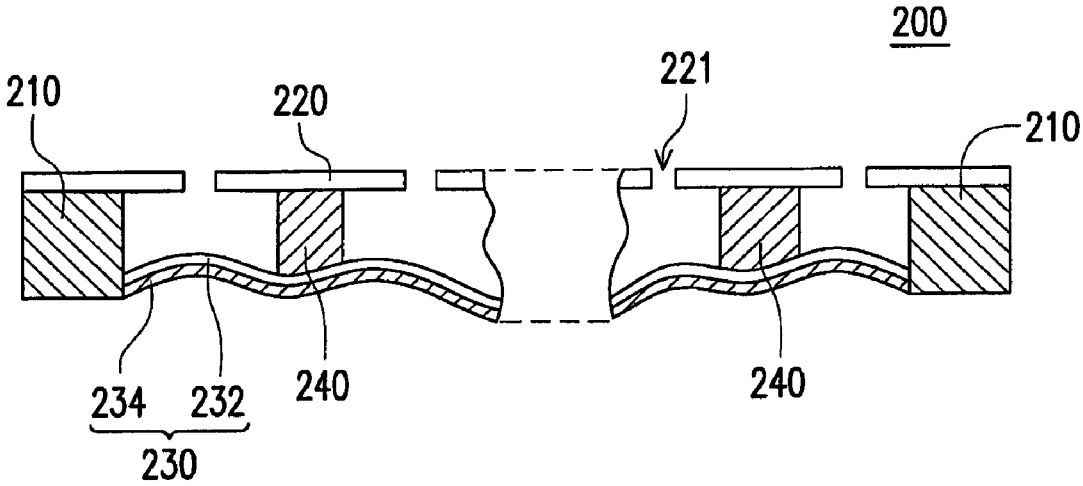

Referring to FIGS. 2A and 2B, schematic sectional views of an embodiment of the speaker structure design are illustrated. A speaker structure 200 includes a frame spacer 210 forming the outline of the speaker, a metal electrode 220 having a plurality of openings 221, a vibrating film 230, and a plurality of spacers 240 there-between. The metal electrode 220 with openings and the vibrating film 230 are respectively fixed on the frame spacer 210, correspond with each other in a face-to-face manner, and do not contact with each other by the supporting of the frame spacer 210 connected to two ends. The height design of the frame spacer 210 can be equivalent to the height of the spacers 240 or higher, and it can be determined according to the design requirement of the speaker structure. The vibrating film 230 includes an electret layer 232 and a conductive electrode layer 234.

In order to prevent the electrostatic effect generated by the vibrating film 230 from resulting in the contact between the vibrating film 230 and the electrode 230 having openings, the plurality of spacers 240 is placed between the metal electrode 220 with openings and the vibrating film 230, but must be located at the non-opening regions of the metal electrode 220 with openings. For the process of the spacers 240, the spacers 240 can be fabricated on the metal electrode 220 with openings, or can be fabricated on the vibrating film 230. In another embodiment, the spacers 240 can also adopt two design manners that the spacers 240 are adhered or not adhered to the vibrating film 230 or the metal electrode 220 with openings. Alternatively, the spacers 240 can be fabricated in advance, and then are placed between the metal electrode 220 with openings and the vibrating film 230 after finishing the fabrication.

As for the distribution of the spacers 240, the quantity of the ferroelectric amount 231 on the vibrating film or the magnitude of the electrostatic effect are taken into consideration to determine the optimal distribution disposition manner, or difference distances of the disposition of the spacers are taken into consideration to determine different spacer height designs. The objective of the above design is to make the metal electrode 220 with openings and the vibrating film 230 have no contacting possibility excepting for the spacer 240, as shown in FIG. 2B.

For the spacer manufacturing process of the present invention, take the spacer structure of the first embodiment as an example, the spacers 240 can also be formed on the metal electrode 220 with openings or the vibrating film 230 by means of transfer-printing or decaling. For the manufacturing process of the spacers 240, in another embodiment, it can be finished by printmaking technology, including directing printing screen printing, or lamination. The spacer 210 can also be fabricated by means of photoresist growing, or etching.

Figure 2C:
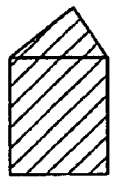
FIGS. 2C, 2D, and 2E are schematic views of different geometric structural shapes of the spacers according to the embodiment of the present invention.
Figure 2D:
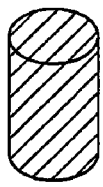
Figure 2E:
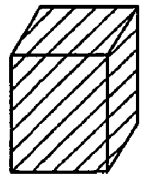

In the present invention, the spacers 240 are placed at the non-opening regions of the metal electrode 220 with openings to perform various designs such as patterning or height change, so as to prevent the phenomenon the metal electrode 220 with openings from contacting with the vibrating film 230. Detailed embodiments of designing different layout manners for the spacers 240 structure provided by the present invention according to different requirements are illustrated hereinafter. The layout manners include the arrangement of the distance between the spacers, or the height of the spacers, or include the layout manners such as the point layout, grid layout, and quasi-cross layout. The outline of the spacers 240 of different geometric shapes are respectively illustrated in FIGS. 2C, 2D, and 2E, including triangular prism, circular cylinder, and rectangle.

Figure 3A:
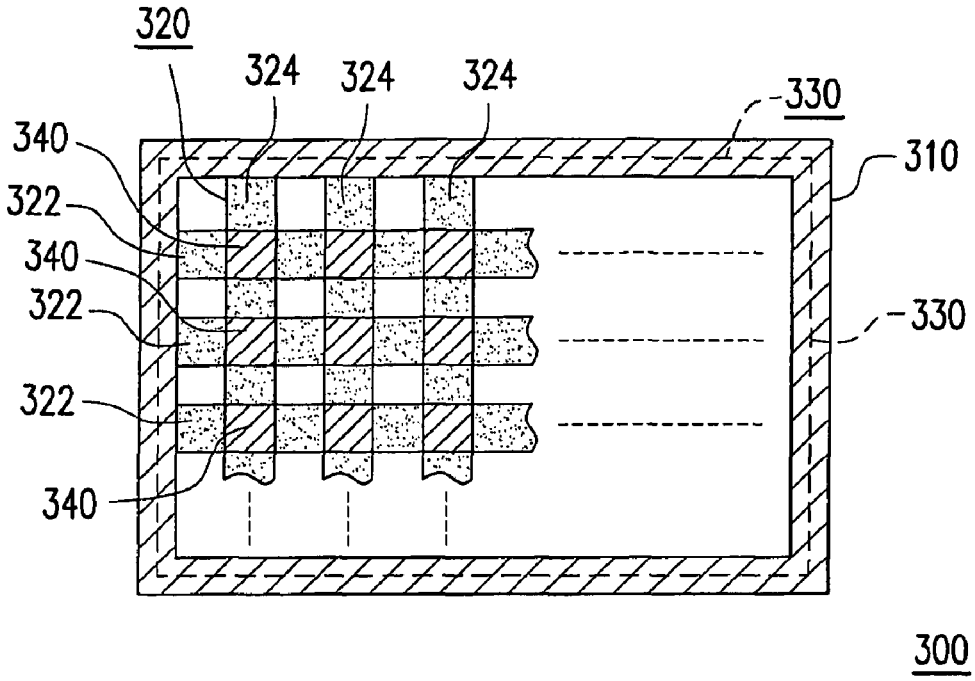
FIG. 3A is a partial schematic top view of the patterned disposition of a point spacer according to the embodiment of the present invention.

Referring to FIG. 3A, a partial schematic top view of the embodiment of the speaker structure design provided by the present invention is illustrated. A speaker structure 300 includes a frame spacer 310 forming the outline of the speaker, a metal electrode 320, and a vibrating film 330. In order to be convenient for illustration, the frame spacer 310 takes a square outer frame as an embodiment for illustration, but it is not limited to square, speaker structure appearance design with any shape can be suitable for this embodiment. The vibrating film 330 is only indicated by dash lines fixed around the frame spacer 310, but it is not limited to be formed by transparent materials. The schematic view is only used for illustration convenience, instead of limitation.

In this embodiment, the shape of the metal electrode 320 includes a plurality of parallel strip electrodes 322 and a plurality of parallel strip electrodes 324, which are disposed in a crossed manner. The metal electrode 320 has an outline design with strip electrodes disposed in a crossed manner. A plurality of spacers 340 having the point structure can be disposed on the non-opening regions at the crossed positions of the strip electrodes 322 and 324. By the point structure spacers 340, the problem that the metal electrode 320 and the vibrating film 330 contact with each other due to the electrostatic force element and fail to sound can be avoided.

Figure 3B:
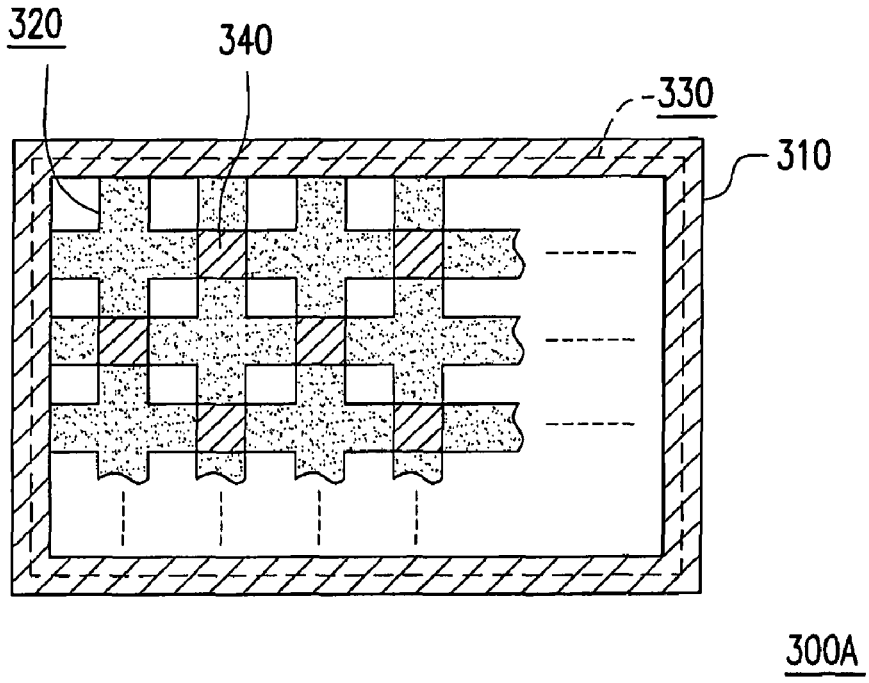
FIG. 3B is a partial schematic top view of an alternation of the patterned disposition of a point spacer in FIG. 3A according to a second embodiment of the present invention.

Referring to FIG. 3B, it is an alternative embodiment of another design of the speaker structure in FIG. 3A, in which the same elements are illustrated by the same numerals. A speaker structure 300A includes a frame spacer 310 forming the outline of the speaker, a metal electrode 320, and a vibrating film 330 (indicated by dashed lines). As shown in the drawing, the metal electrode 320 has an outline design with strip electrode disposed in a crossed manner, and a plurality of spacers 340 having the point structure can be selectively disposed on the non-opening regions on the crossed positions, instead of disposing the spacers 340 on the crossed positions as shown in FIG. 3A. The point spacers 340 are selectively disposed, and the position requiring the disposition can be adjusted according to the design of the speaker structure, for example according to the practical state of the ferroelectric amount on the vibrating film 330, or the distance between the metal electrode 320 and the vibrating film 330.

Figure 4A:
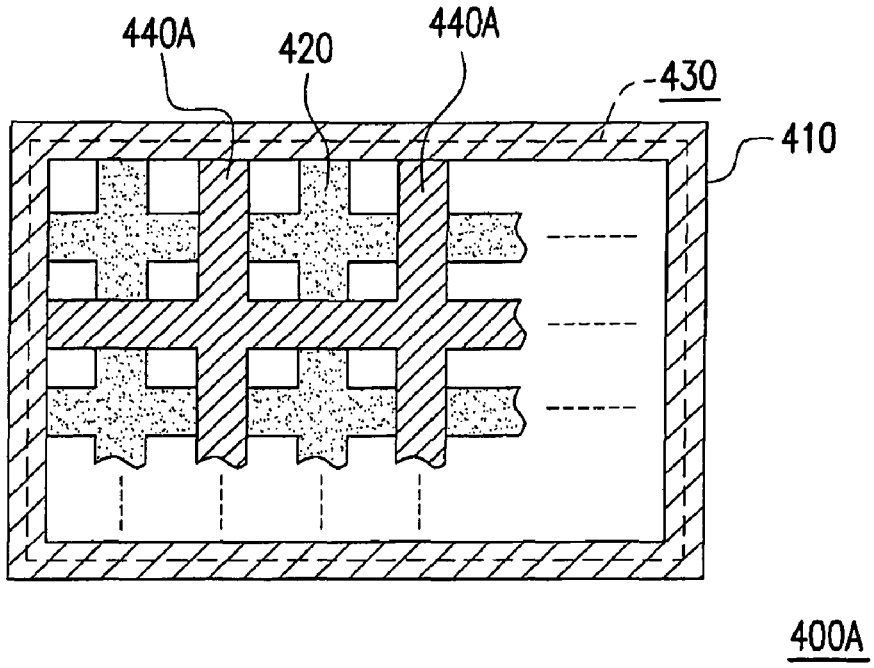
FIG. 4A is a partial schematic top view of the patterned disposition of a strip spacer according to another embodiment of the present invention.

Referring to FIG. 4A, it is a partial schematic top view of another embodiment of the speaker structure design provided by the present invention. A speaker structure 400A includes a frame spacer 410 forming the outline of the speaker, a metal electrode 420, and a vibrating film 430. In order to be convenient for illustration, the frame spacer 410 takes a square outer frame as an embodiment for illustration, but it is not limited to square, speaker structure appearance design with any shape can be suitable for this embodiment. The vibrating film 430 is only indicated by dash lines fixed around the frame spacer 410, but it is not limited to be formed by transparent materials. The schematic view is only used for illustration convenience, instead of limitation. The metal electrode 420 has a shape similar to the metal electrode shape as shown in FIG. 3A, that is, having the outline design with strip electrodes disposed in a crossed manner. For the speaker structure design, the difference with FIG. 3A is that the frame spacers are a plurality of strip spacers 440A having the strip structure. The strip spacers 440A are disposed at the non-opening positions spaced by horizontal strip electrode or vertical strip electrode of one metal electrode 420, that is, the trip spacers 440A are disposed in a crossed manner with elongated strip shape.

Figure 4B:
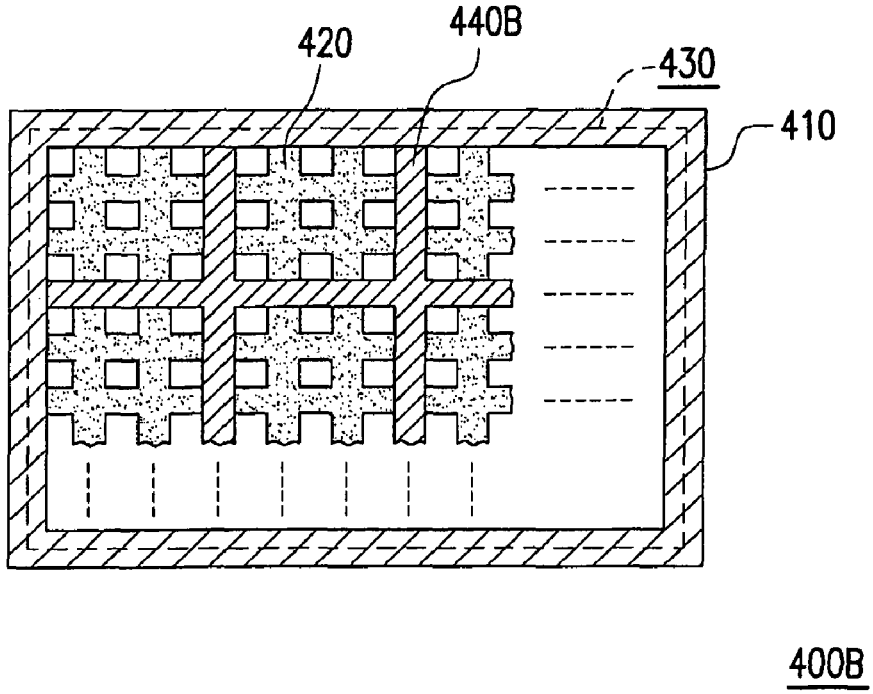
FIG. 4B is a partial schematic top view of an alternation of the patterned disposition of the strip spacer in FIG. 4A according to another embodiment of the present invention.

Referring to FIG. 4B, it is a partial schematic top view of another embodiment of the design of the speaker structure provided by the present invention. The whole architecture of a speaker structure 400B has the same design concept as that of FIG. 4A, except for the disposition of the grid spacers or strip spacers. In the speaker structure 400B, the strip spacers 440B are located at the non-opening positions spaced by horizontal strip electrodes or vertical strip electrodes of a plurality of metal electrodes 420, that is, the strip spacers 440B are disposed in a crossed manner with elongated strip shape.

Figure 5B:
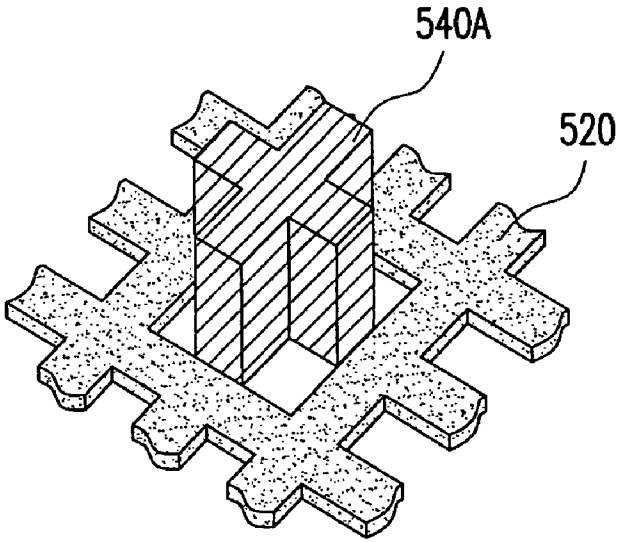
FIGS. 5A and 5B are partial schematic top views of the patterned disposition of a quasi-cross spacer according to another embodiment of the present invention.
Figure 5A:
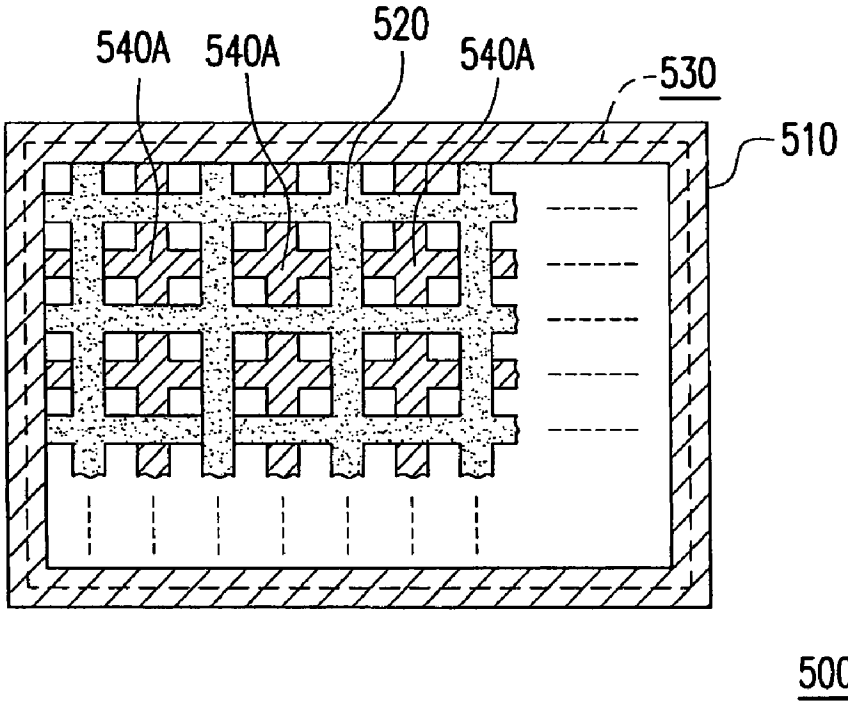

Referring to FIGS. 5A and 5B, a partial schematic top view and a schematic side view of another embodiment of the speaker structure design provided by the present invention are shown. A speaker structure 500A includes a frame spacer 510 forming the outline of the speaker, a metal electrode 520, and a vibrating film 530. In order to be convenient for illustration, the frame spacer 510 takes a square outer frame as an embodiment for illustration, but it is not limited to square, speaker structure appearance design with any shape can be suitable for this embodiment. The vibrating film 530 is only indicated by dash lines fixed around the frame spacer 510, but it is not limited to be formed by transparent materials. The schematic view is only used for illustration convenience, instead of limitation. The metal electrode 520 has a shape similar to the metal electrode shape as shown in FIG. 3A, that is, having the outline design with strip electrodes disposed in a horizontal and vertical crossed manner. For the speaker structure 500A design, the difference with FIG. 3A is that the frame spacers are a plurality of spacers 540A having the quasi-cross structure. For the disposition positions of the spacers 540A having the quasi-cross structure, a spacer 540A with the quasi-cross structure is disposed on the crossed non-opening position spaced by horizontal strop electrode or vertical strip electrode of a metal electrode 520, as shown in FIG. 5B.

Figure 5C:
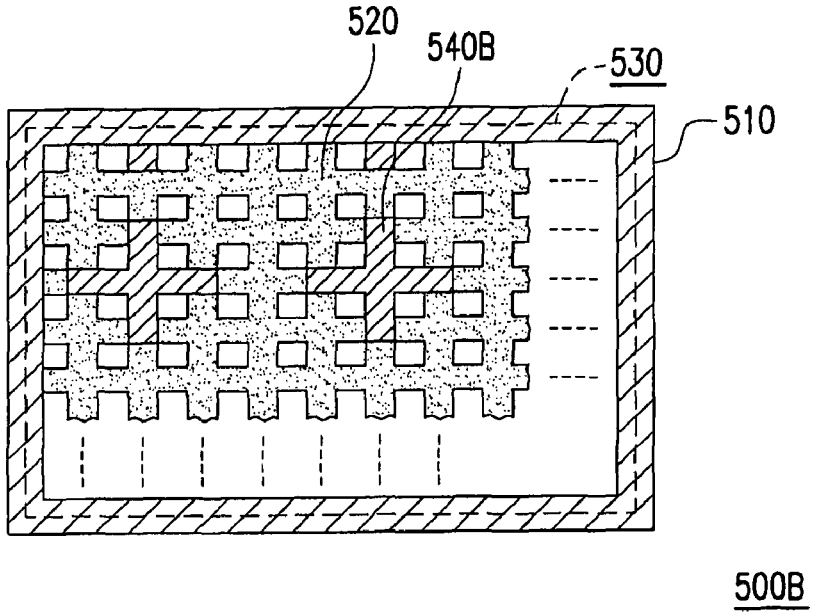
FIG. 5C is a partial schematic top view of an alternation of the patterned disposition of the quasi-cross spacer in FIG. 5A according to another embodiment of the present invention.

Referring to FIG. 5C, it is a partial schematic top view of another embodiment of the speaker structure design provided by the present invention. The whole architecture of the speaker structure 500B has the same design concept as that of FIG. 5A, except for the disposition position of the spacers 540A with the quasi-cross structure. In the speaker structure 500B, the spacers 540A with the quasi-cross structure are selectively disposed at the crossed non-opening positions spaced by horizontal strop electrodes or vertical strip electrodes of a plurality of metal electrodes 420, and different layout manners are designed for the length of the spacers 540A with the quasi-cross structure according to different requirements.

Figure 6:
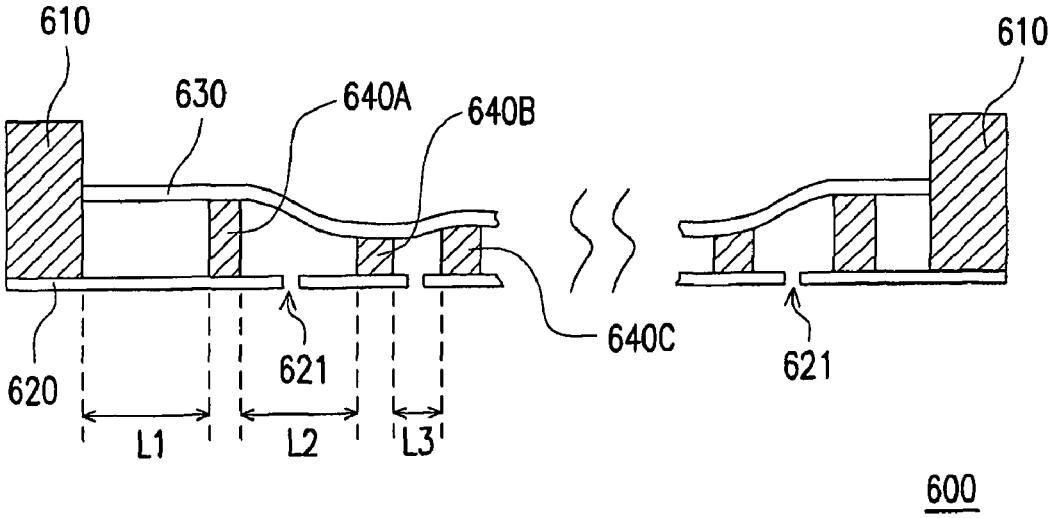
FIG. 6 is a partial schematic sectional view of a spacer height and distance structure according to another embodiment of the present invention.

Referring to FIG. 6, it is a partial schematic sectional view of another embodiment of the speaker structure design provided by the present invention. A speaker structure 600 includes a frame spacer 610 forming the outline of the speaker, a metal electrode 620 having a plurality of openings 621, a vibrating film 630, and a plurality of spacers therebetween. The metal electrode 620 with openings and the vibrating film 630 are respectively fixed on the frame spacer 610, correspond with each other in a face-to-face manner, and do not contact with each other by the supporting of the frame spacer 610 connected to two ends. In order to prevent the vibrating film 630 from contacting with the electrode 630 with openings due to the electrostatic effect generated by the vibrating film 630, the plurality of spacers is placed between the metal electrode 620 with openings and the vibrating film 630. In this embodiment, spacers with different heights exist, here, only spacers 640A, 640B, and 640C as shown in FIG. 6 are used for explanation, but the quantity is not limited herein.

The distances between the spacers 640A, 640B, and 640C are different, for example as shown in the drawing, the distance between the frame spacer 610 and the spacer 640A is L1, the distance between the spacer 640A and 640B is L2, and the distance between the spacer 640B and 640C is L3. L1>L2>L3, so the vibrating film 630 is located between the frame spacer 610 and the spacer 640A, such that the effect of resisting the electrostatic effect of the vibrating film 630 is relatively weak because the distance is too far. Under this condition, the selected height of the spacer 640A can be relatively high. In addition, the distances between the spacers 640A and 640B and between the spacers 640B and 640C are relatively small, so the height can be relatively lower than the selected height of the spacer 640A.

In order to enhance the effect of the frequency response of the speaker, disposition designs with different spacer distances can be performed for the spacers, and spacers with suitable height are designed on the relative position according to the disposition design. Alternatively, the ferroelectric strength and the electrostatic effect magnitude on the vibrating film 630 of different regions or flexing situations may be taken into consideration, such that the spacers with different heights can be disposed on several distances, so as to prevent the metal electrode 620 with openings from contacting with the vibrating film 630.

To sum up, the present invention can solve the technical problem that the metal electrode and the electret vibrating film contact with each other due to the electrostatic force element and fail to sound. The spacer of the speaker has simple construction and can match with the current technology to perform the process, it is suitable for mass production, so as to enhance the practicability of the flat plane electrostatic speaker product. The present invention, used together with the selection of the flexible material, breaks through the conventional fixed speaker design structure, and finishes sound components with features required by the flexible electronics. It can be expected to be one of the important structure constructing technologies of the flat plane speaker.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A speaker structure, comprising:

a vibrating film;

an electrode, having a plurality of openings;

a frame spacer, having two opposite sides, each of which respectively connecting to the vibrating film and the electrode; and a plurality of spacers, disposed between non-opening regions of the electrode and the vibrating film, thereby preventing the vibrating film from contacting with the electrode, wherein a layout of the plurality of spacers is adjusted by distances between the adjacent spacers and heights of the spacers.

2. The speaker structure as claimed in claim 1, wherein the layout of the plurality of spacers is further arranged in a geometric outline manner, and the geometric outline manner is determined according to the magnitude of electrostatic effect of the vibrating film.

3. The speaker structure as claimed in claim 2, wherein the geometric outline formed by the layout of the spacers is quasi-rectangle, round, or triangle.

4. The speaker structure as claimed in claim 1, wherein the outline of the spacers is triangular prism, circular cylinder, or rectangle.

5. The speaker structure as claimed in claim 1, wherein the spacers are formed on the electrode or the vibrating film by transfer-printing.

6. The speaker structure as claimed in claim 5, wherein the transfer-printing comprises one of jet printing or screen printing.

7. The speaker structure as claimed in claim 1, wherein the spacers are formed on the electrode or the vibrating film by decaling.

8. The speaker structure as claimed in claim 7, wherein during the decaling, the spacers are adhered to the vibrating film or the electrode.

9. The speaker structure as claimed in claim 7, wherein during the decaling, the spacers are not adhered to the vibrating film or the electrode.

10. The speaker structure as claimed in claim 1, wherein the spacers are formed on the electrode or the vibrating film by etching.

11. The speaker structure as claimed in claim 1, wherein the spacers are formed on the electrode or the vibrating film by photolithography.

12. The speaker structure as claimed in claim 1, wherein the spacers are made of transparent and flexible material.

13. The speaker structure as claimed in claim 1, wherein the spacers are of a point structure.

14. The speaker structure as claimed in claim 1, wherein the spacers are of a grid structure.

15. The speaker structure as claimed in claim 1, wherein the spacers are of a quasi-cross structure.

16. The speaker structure as claimed in claim 1, wherein the material of the electrode is metal material, and the spacers are located between the metal electrode and vibrating film.

17. The speaker structure as claimed in claim 1, wherein the vibrating film at least comprises an electret layer and a conductive electrode layer.

18. The speaker structure The speaker structure as claimed in claim 17, wherein the electret layer comprising electret material, wherein the electret material comprises one selected from fluorinated ethylenepropylene (FEP), polytetrafluoethylene (PTFE), polyvinylidene fluride (PVDF), a portion of the fluorine polymer, or a combination thereof.

19. A speaker structure, comprising:

a vibrating film;

an electrode, having a plurality of openings;

a frame spacer, having two opposite sides, each of which respectively connecting to the vibrating film and the electrode; and a plurality of spacers, disposed between non-opening regions of the electrode and the vibrating film according to a layout, thereby preventing the vibrating film from contacting with the electrode, wherein the layout of the plurality of spacers is adjusted by the distances between the adjacent spacers and heights of the spacers.

20. The speaker structure as claimed in claim 19, wherein the layout of the plurality of spacers is further arranged in a geometric outline manner, and the geometric outline manner is determined according to the magnitude of the electrostatic effect of the vibrating film.

21. The speaker structure as claimed in claim 20, wherein the geometric outline formed by the layout of the spacers is quasi-rectangle, round, or triangle.

22. The speaker structure as claimed in claim 19, wherein the outline of the spacers is triangular prism, circular cylinder, or rectangle.

23. The speaker structure as claimed in claim 19, wherein the electrode is composed by a plurality of strip electrodes disposed in a crossed manner, and the spacers are selectively disposed on the non-opening regions at the crossed positions.

24. The speaker structure as claimed in claim 23, wherein the spacers are of a point structure.

25. The speaker structure as claimed in claim 23, wherein the spacers are of a grid structure.

26. The speaker structure as claimed in claim 23, wherein the spacers are of a quasi-cross structure.

27. The speaker structure as claimed in claim 19, wherein the vibrating film at least comprises an electret layer and a conductive electrode layer.

28. A method of manufacturing a speaker, comprising:

forming an electrode;

forming a frame spacer, comprising a first side and a second side, wherein the first side is opposite to the second side, wherein the first side of the frame spacer connects to the electrode; and forming a vibrating film, fixed on the second side of the frame spacer, wherein the electrode and the vibrating film are respectively fixed on the first side and the second side of the frame spacer and facing each other, and a space is formed between the electrode and the vibrating film, a plurality of spacers is disposed between non-opening regions of the electrode and the vibrating film, thereby preventing the vibrating film form contacting with the electrode, wherein the layout of the plurality of spacers is adjusted by distances between the adjacent spacers and heights of the spacers.

29. The method of manufacturing a speaker as claimed in claim 28, wherein the spacers are formed on the electrode or the vibrating film by transfer-printing.

30. The method of manufacturing a speaker as claimed in claim 29, wherein the transfer-printing comprises one of jet printing or screen printing.

31. The method of manufacturing the speaker as claimed in claim 28, wherein the spacers are fanned on the electrode or the vibrating film by decaling.

32. The method of manufacturing the speaker as claimed in claim 31, wherein during the decaling, the spacers are adhered to the vibrating film or the electrode.

33. The method of manufacturing the speaker as claimed in claim 31, wherein during the decaling, the spacers are not adhered to the vibrating film or the electrode.

34. The method of manufacturing the speaker as claimed in claim 28, wherein the spacers are formed on the electrode or the vibrating film by etching.

35. The method of manufacturing the speaker as claimed in claim 28, wherein the spacers are formed on the electrode or the vibrating film by photolithography.

* * * * *